United States Patent [19]

Freij

[11] Patent Number: 4,906,303

[45] Date of Patent: Mar. 6, 1990

[54] PROCESS FOR THE CLEANING OF ARTICLES OR SURFACES AND A CLEANER BATH TO BE USED IN THE PROCESS

[76] Inventor: Göran H. Freij, S-270 10 Skivarp, Duvinge Gård, Sweden

[21] Appl. No.: 201,699

[22] Filed: Jun. 3, 1988

[30] Foreign Application Priority Data

Jun. 5, 1987 [SE] Sweden ..... 8702356

[51] Int. Cl.[4] ..... B08B 3/08

[52] U.S. Cl. ..... 134/38; 134/40; 134/42; 252/364; 252/542; 252/DIG. 8

[58] Field of Search ..... 134/38, 40, 42; 252/541, 542, DIG. 8, 364

[56] References Cited

U.S. PATENT DOCUMENTS

| | | | |
|---|---|---|---|
| 4,055,515 | 10/1977 | Kirch | 252/542 |
| 4,085,059 | 4/1978 | Smith et al. | 134/38 |
| 4,120,810 | 10/1978 | Palmer | 252/542 |
| 4,276,186 | 6/1981 | Bakos et al. | 134/40 |
| 4,428,871 | 1/1984 | Ward et al. | 134/38 |
| 4,744,834 | 5/1988 | Haq | 134/38 |
| 4,812,255 | 3/1989 | Swoala | 134/38 |
| 4,828,569 | 5/1989 | Heath et al. | 252/542 |
| 4,836,950 | 6/1989 | Madsen et al. | 252/542 |

OTHER PUBLICATIONS

"NMP. N-Methyl-2-Pyrrolidone, Handbook", GAF Corporation, International Operations, New York, U.S.A. (1972).

*Primary Examiner*—Asok Pal

*Attorney, Agent, or Firm*—Fleit, Jacobson, Cohn, Price, Holman & Stern

[57] ABSTRACT

The invention relates to a process for the cleaning of articles or surfaces using a liquid cleaner of low viscosity containing N-methyl-2-pyrrolidone by immersion into a bath containing said cleaner. According to the invention the water content of the cleaner is kept at desired low values by means of a water absorption preventing layer applied on the surface of the cleaner and comprising at least one liquid, aliphatic hydrocarbon, which is immiscible with N-methyl-2-pyrrolidone and has a straight, branched or ring-closed carbon chain, or comprising microballoons or microspheres of a hydrophobic material which is insoluble in N-methyl-2-pyrrolidone.

9 Claims, No Drawings

PROCESS FOR THE CLEANING OF ARTICLES OR SURFACES AND A CLEANER BATH TO BE USED IN THE PROCESS

The present invention relates to a process for the cleaning of articles or surfaces using a liquid cleaner of low viscosity containing N-methyl-2-pyrrolidone by immersion into a bath. The invention also relates to a cleaner bath to be used in the process according to the invention.

N-methyl-2-pyrrolidone (NMP) is known as an excellent solvent for a very great number of organic compounds and a great number of applications in practice based on th dissolving ability of NMP have been proposed. An extensive summary of the properties and applications of NMP consists of "NMP N-Methyl-2-Pyrrolidone, Handbook", published by GAF Corporation International Operations, New York, USA (1972). With respect to the use of NMP for cleaning purposes such as removal of paint and other surface coatings, removal of soot, cleaning of oil cisterns and similar uses, reference can be made to pages 51–55 of this reference. Reference is especially made to page 51, where cleaning of i.a. electronic devices and cleaning in connection with watch repairing in ultrasonic baths are mentioned, the bath being reported to consist of an aqueous solution containing 10% NMP and 0,5% of a nonionic surfactant.

NMP is a comparatively expensive solvent. Moreover, NMP is strongly hygroscopic as is evident from FIG. 12 on page 105 of the above-mentioned handbook, from which an increase in weight of about 50% within 6 hours and a levelling-off of the curve at about 65% after about 12 h at a wide Petridish can be seen. These two factors taken together has resulted in using NMP in the form of extensively diluted solutions in applications which involve the use of great amounts of cleaner with repeated use of the cleaner.

The dissolving ability of NMP is weakened with increasing dilution and consequently the quality of a bath with at the outset substantially anhydrous NMP will rapidly be impaired by absorption of water from the air when cleaning a number of articles, which are immersed into the bath one after the other, as a result of which it will become difficult to arrive at the same cleaning effect for all articles.

An object of the present invention is consequently to provide a process for the cleaning of articles and surfaces which enables rapid and effective cleaning with a well reproducible result. Another object is to provide a cleaner bath, which can be used for attaining a rapid and effective cleaning of articles or surfaces with a well reproducible result.

The first-mentioned object is arrived at by a process of the type mentioned by way of introduction above, which process is characterized in that the water content of the cleaner is kept at desired low values of at most 20% by weight, preferably at most 10% by weight, calculated on the total weight of N-methyl-2-pyrrolidone and water, by means of a water absorption preventing layer applied on the surface of the cleaner and comprising at least one liquid aliphatic hydrocarbon, which is immiscible with N-methyl-2-pyrrolidone and has a straight branched or ring-closed carbon chain, or microballoons or microspheres of a hydrophobic material which is insoluble in N-methyl-2-pyrrolidone.

According to a preferred embodiment of the process according to the invention, a cleaner is used which in addition to N-methyl-2-pyrrolidone comprises at most 20% by weight, preferably at most 10% by weight of water, calculated on the total weight of N-methyl-2-pyrrolidone and water, and in addition thereto optionally comprises at least one component selected from (a) cover aromas, (b) tensides and (c) diluents in the form of liquid environmentally acceptable organic compounds which are miscible with N-methyl-2-pyrrolidone, component (c) being used in an amount of at most 50% by weight, preferably at most 40% by weight, calculated on the weight of the N-methyl-2-pyrrolidone.

By using a water absorption preventing layer in accordance with the invention a considerable retardation of the water absorption of the cleaner is achieved. When the water content, in spite of this layer being used, has reached a certain level, e.g. the limit for the highest acceptable content, it may be decreased, for instance by periodically withdrawing a stream of the cleaner from the bath and passing it through a heating zone and back to the bath. Alternatively, a certain amount of the cleaner can be withdrawn and transferred to a separate vessel, where at least part of the water contained in the cleaner is caused to evaporate. At the end of the evaporation process, the cleaner thus treated is returned to the bath.

In case of this embodiment the water content of the bath will vary between a comparatively low value immediately after returning of heat-treated cleaner to the bath and a comparatively high value just before part of the cleaner is withdrawn for heat treatment. Preferably this variation is kept as small as possible by withdrawing cleaner more frequently.

The process according to the invention can, if desired, be applied to ultrasonic cleaning.

According to another aspect of the invention, the invention relates to a cleaner bath intended to be used in the process according to the invention. This bath is characterized in that it comprises a cleaner in the form of a liquid of low viscosity and containing N-methyl-2-pyrrolidone and a water absorption preventing layer applied on the surface of the cleaner and comprising at least one liquid, aliphatic hydrocarbon, which is immiscible with N-methyl-2-pyrrolidone and has a straight, branched or ring-closed carbon chain, or comprising microballoons or microspheres of a hydrophobic material which is insoluble in N-methyl-2-pyrrolidone.

Preferably, non-aromatic petroleum spirits, paraffins or isoparaffins or a mixture thereof are used as the water absorption preventing layer. Examples of such products are those marketed under the Trade Names Shellsol T, which is a white spirit made non-aromatic by transforming the aromatic hydrocarbons into naphthenes, which has a content of aromatic hydrocarbons of less than 0.5% by weight, which contains isoparaffins $C_{11}$–$C_{13}$ and which has a boiling point interval of 180°–212° C. and which is marketed by AB Svenska Shell, Solna, Sweden, Shellsol D70, which is a mixture of 50% naphthenes and 50% aliphatic hydrocarbons with n-paraffins and isoparaffins in $C_{11}$–$C_{13}$ and the boiling point interval of 194°–251° C. and which is marketed by AB Svenska Shell, Solna, Sweden, and Halpasol 190–240, which is a mixture of 99% nparaffins and 1% isoparaffins $C_{11}$–$C_{13}$, boiling point interval 190°–240° C., and which is marketed by Halterman AB, Malmö, Sweden.

The term "non-aromatic" is used in this connection here and in the claims to designate a content of aromatic hydrocarbons of less than 0.5% by weight.

The aliphatic hydrocarbons or the mixture of such hydrocarbons is applied onto the cleaner to a layer thickness of at least 5 mm, preferably 7–15 mm.

According to the invention the water absorption preventing layer may also be formed by microballoons or microspheres of a hydrophobic material which is insoluble in N-methyl-2-pyrrolidone, in which case a mixture of microballoons and microspheres, respectively, of different particle sizes are preferably used in order to obtain a tighter layer. The thickness of the layer is adjusted to the tightness of the layer so that the penetration of water through the layer is prevented to the desired extent. An example of materials to be used in this connection is spheres of phenol resin.

According to a preferred embodiment of the bath according to the invention, the cleaner of the bath contains in addition to N-methyl-2-pyrrolidone at most 20% by weight, preferably at most 10% by weight of water, calculated on the total weight of N-methyl-2-pyrrolidone and water, and in addition thereto possibly at least one component selected from (a) cover aromas (b) tensides and (c) diluents in the form of liquid, environmentally acceptable organic compounds which are miscible with N-methyl-2-pyrrolidone, component (c) being present in an amount of at most 50% by weight, preferably at most 40% by weight, calculated on the weight of the N-methyl-2-pyrrolidone.

A cover aroma may form part of the cleaner used in the invention in order to conceal the characteristic smell of N-methyl-2-pyrrolidone. Examples of substances to be used in this connection are isobornyl acetate, oil of citronella and food aromas of the type orange or other citrus aroma.

As a tenside, which can be present in the cleaner used in the invention, such a tenside is used which is soluble in or miscible with water and paraffinic hydrocarbons.

The tenside may be non-ionic, cationic or anionic and can be used alone or in mixture with other tensides. Examples of suitable tensides are nonylphenol polyethylene oxides.

The amounts of these components (a) and (b) are adjusted to give the desired effect.

A glycol, glycol ether or alcohol can be used as component (c). The substance preferably used as this component is propylene glycol.

The process according to the invention can, for instance, be used for the cleaning from pollutions, such as oil, fat, soot, paint and glue. An important field of application in this connection is the degreasing of metal surfaces or metal articles before further surface treatment such as lacquering, galvanizing or chromium-plating. Another field of application is the cleaning of dental prosthesis, which is preferably carried out ultrasonically.

The treatment with the cleaner bath according to the invention is usually performed at temperatures of at least 50° C., preferably at 85°–90° C.

Furthermore, the treatment can be performed with or without stirring of the bath, circulation in the latter case being brought about by means of a propeller or a pump.

After the treatment in the bath, residues of the cleaner possibly remaining on the surface or on the article can be removed by being wiped off with a rag or similar means or by rinsing with water.

The invention will be further illustrated in the following with reference to a number of working examples.

EXAMPLE 1

N-methyl-2-pyrrolidone (NMP) in non-aqueous, undiluted (100%) form is charged into a vessel of metal and is overlaid with a mixture of paraffinic hydrocarbons in liquid form (Isopar L, isoparaffins, $C_{11}$–$C_{13}$, boiling point interval 190°–210° C., from Esso Chemical AB, Stenungsund, Sweden) to a layer thickness of 7–10 mm.

The bath thus obtained is suited for the cleaning of surfaces polluted by oils or fats and dirt attached thereto and for the removal of paint.

The article or object to be cleaned is immersed into the liquid and is kept in the bath, which is held at room temperature (about 25° C.) for the approximate times given below without stirring the liquid. After being taken out from the bath the article or object is washed or rinsed with water or another liquid which is suitable from environmental point of view.

Suitable times for treatment are:

(a) in case of slight oil pollutions about 10 minutes, (b) in case of thick layers about 20 minutes, (c) in case of removal of coatings such as paint, convertible coatings etc. about 120 minutes.

EXAMPLE 2

A bath is prepared in the same manner as described in Example 1 but the treatment is carried out at a bath temperature of 60°–80° C.

In comparison with Example 1 the time required for the treatment can be reduced to about one-half thereof in cleaning of types (a) and (b) and to somewhat more than one-half of the time in cleanings of type (c).

Additional gains in time can be obtained if the bath is stirred with a pump or a propeller.

EXAMPLE 3

100 parts by weight of NMP in non-aqueous (100%) form and 50 parts by weight of propylene glycol are charged into a vessel of metal and overlaid with a mixture of paraffinic hydrocarbons in liquid form (Halpasol 190–240 from Halterman AB, Malmö, Sweden) to a layer thickness of 5–10 mm.

This bath can be used for the cleaning of surfaces which are polluted by oils or fats and dirt attached thereto, the same results as in Examples 1(a) and (b) being obtained in substantially the same time but painted or lacquered surfaces remaining intact.

A reduction of the time required for the treatment can be obtained by the corresponding measures as in Example 2.

I claim:

1. Process for the cleaning of articles or surfaces using a liquid cleaner of low viscosity containing N-methyl-2-pyrrolidone by immersion into a bath, which process comprises keeping the water content of the cleaner at desired low values of at most 20% by weight, preferably at most 10% by weight, calculated on the total weight of N-methyl-2-pyrrolidone and water, by means of a water absorption preventing layer applied on the surface of the cleaner and comprising at least one liquid aliphatic hydrocarbon, which is immiscible with N-methyl-2-pyrrolidone and has a straight, branched or ring-closed carbon chain, or microballoons or microspheres of a hydrophobic material which is insoluble in N-methyl-2-pyrrolidone.

2. Process according to claim 1, wherein a cleaner is used which in addition to N-methyl-2-pyrrolidone comprises at most 20% by weight, preferably at most 10% by weight of water, calculated on the total weight of N-methyl-2-pyrrolidone and water, and in addition thereto optionally comprises at least one component selected from (a) cover aromas,
(b) tensides and
(c) diluents in the form of liquid environmentally acceptable organic compounds which are miscible with N-methyl-2-pyrrolidone, component (c) being used in an amount of at most 50% by weight, preferably at most 40% by weight, calculated on the weight of the N-methyl-2-pyrrolidone.

3. Process according to claim 2, wherein a glycol, glycol ether or alcohol, preferably propylene glycol, is used as component (c).

4. Process according to claim 1, wherein the water preventing layer consists of non-aromatic petroleum spirits, paraffins or isoparaffins or a mixture thereof.

5. Process according to claim 1, wherein the cleaning is carried out ultrasonically.

6. Cleaner bath to be used in the process for the cleaning of articles and surfaces which bath comprises a cleaner form of a liquid of low viscosity and containing N-methyl-2-pyrrolidone and a water absorption preventing layer applied on the surface of the cleaner and comprising at least one liquid, aliphatic hydrocarbon, which is immiscible with N-methyl-2-pyrrolidone and has a straight, branched or ring-closed carbon chain, or comprising microballoons or microspheres of a hydrophobic material which is insoluble in N-methyl-2-pyrrolidone.

7. Cleaner bath according to claim 6, wherein the water absorption preventing layer consists of non-aromatic petroleum spirits, paraffins or isoparaffins or a mixture thereof.

8. Cleaner bath according to claim 6, wherein the cleaner of the bath contains in addition to N-methyl-2-pyrrolidone at most 20% by weight, preferably at most 10% by weight of water, calculated on the total weight of N-methyl-2-pyrrolidone and water, and in addition thereto possibly at least one component selected from (a) cover aromas,
(b) tensides and
(c) diluents in the form of liquid, environmentally acceptable organic compounds, which are miscible with N-methyl-2-pyrrolidone, component (c) being present in an amount of at most 50% by weight, preferably at most 40% by weight, calculated on the weight of the N-methyl-2-pyrrolidone.

9. Cleaner bath according to claim 8, wherein component (c) is a glycol, glycol ether or alcohol, preferably propylene glycol.

* * * * *